US006340188B1

(12) United States Patent
Cuti

(10) Patent No.: US 6,340,188 B1
(45) Date of Patent: Jan. 22, 2002

(54) TENNIS BUTLER

(76) Inventor: Phil Cuti, 6874 Sedgewick Ct., Fort Myers, FL (US) 33919

( * ) Notice: Subject to any disclaimer, the term of this patent is extended or adjusted under 35 U.S.C. 154(b) by 0 days.

(21) Appl. No.: 09/853,012

(22) Filed: May 11, 2001

(51) Int. Cl.[7] ..... A63B 47/02
(52) U.S. Cl. ..... 294/19.2; 294/142
(58) Field of Search ..... 294/19.2, 141–143, 294/146, 147; 56/328.1; 206/315.1, 315.9; 224/919

(56) References Cited

U.S. PATENT DOCUMENTS 3,209,870 A * 10/1965 Johns ..... 294/143 X
3,963,103 A * 6/1976 Cowen ..... 206/315.1 X
4,194,779 A * 3/1980 Ouhashi ..... 294/19.2
4,461,504 A * 7/1984 Perez et al. ..... 294/19.2
4,643,317 A * 2/1987 Wilkinson et al. ..... 294/19.2 X
5,086,948 A * 2/1992 Slusarz ..... 294/19.2 X
5,368,351 A * 11/1994 Cuti ..... 294/19.2
5,476,297 A * 12/1995 Lombard ..... 294/19.2

* cited by examiner

*Primary Examiner*—Johnny D. Cherry
(74) *Attorney, Agent, or Firm*—Frank A. Lukasik

(57) ABSTRACT

A tennis ball retriever and multi-purpose tennis ball hopper and caddy that holds all of the tennis equipment used during play and practice. The retriever utilizes a hopper portion incorporating a pair of opening spaces with a plurality of fingers formed therein for permitting tennis balls to pass into the hopper. The invention includes a small storage unit for valuables and for new and practice tennis balls. The carrying handle is retractable thereby taking up less space than conventional tennis hoppers.

1 Claim, 6 Drawing Sheets

TENNIS BUTLER

BACKGROUND OF THE INVENTION

1. Field of the Invention

This invention relates generally to a tennis ball retriever, and more particularly to a multi-purpose tennis ball hopper and caddy that holds all of the tennis equipment used during play and practice.

2. Description of the Prior Art

It is well known to provide devices for carrying and/or picking up tennis balls. Such devices are widely used by instructors as well as by players. Examples of such devices are hoppers made of wire construction which are hand carried and lifted to a desired place on the tennis court. These hoppers carry as many as 30 to 100 balls and can be used to pick stray balls by positioning them over the balls and pressing the ball or balls against the wire construction. Another transport device is a cart that can hold twice as many balls and is pushed around the court. Alternatively, a ball retaining device may be worn by the player.

Various devices have in the past been developed as tennis ball retrievers. One such device is shown in U.S. Pat. No. 4,461,504 to Perez et al which discloses a container having a bottom wall with slotted apertures having thin parallel side edge members through which tennis balls can be squeezed. At least one edge member of each aperture includes a roller to reduce the frictional resistance to the entry of the ball through the aperture. A support is provided for supporting the container with the bottom wall spaced above the supporting surface to prevent wear on the bottom wall.

U.S. Pat. No. 5,086,948 to Slusarz discloses a tennis ball pack dispensing and retrieving apparatus while positioned on a player's back and retrieving balls in another mode of operation upon removal from the back. U.S. Pat. No. 3,957,297 to Hanks discloses a tennis ball retriever comprising a tube having an inlet through which a ball may pass, and a set of arcuate arms pivotally mounted to the tube adjacent the inlet for movement between positions of greater and lesser proximity to the interior walls of the tube. The arms are spring biased towards their position of lesser proximity where stop means are located.

U.S. Pat. No. 3,820,836 to Seewagen et al discloses a tennis ball retriever device comprising a receptacle having an open top and a substantially open bottom for holding a plurality of tennis balls. An access arrangement normally in substantially horizontal planar position is provided in the bottom of the receptacle for admitting tennis balls into the receptacle and for preventing balls from falling out. The access arrangement comprises an access device yieldable under the pressure of a tennis ball in a direction into the receptacle to permit the entry of a tennis ball and instantly returnable to prevent the egress of a tennis ball from the receptacle.

U.S. Pat. No. 4,412,697 to Verde discloses a tennis ball retrieving storage container having a pair of handles hingedly fixed thereto which may be folded to a downwardly extending position supporting the container on a playing surface. The retrieving device includes a plurality of parallel rods extending across the bottom of the container. When folded upwardly, the handles of the container enable an operator to both carry and retrieve balls from a playing surface without bending or stooping.

U.S. Pat. No. 3,804,449 to Falitz discloses a tennis ball retriever having a handle in the form of a yoke and a pair of second engaging rings interconnected by spaced bars, one of which is removable to provide for access of tennis balls picked up through the spaced bars after rolling the rings along the ground.

U.S. Pat. No. 5,368,351 to Cuti discloses a tennis ball retriever and multi-purpose tennis ball hopper and caddy that holds all of the tennis equipment used during play and practice.

Conventional ball storage devices with handles provided on containers are limited to the single function of carrying the container around. It is generally desirable for the container to be adapted for retrieving the balls from the court surface without an undue amount of bending and stooping. While retrieving tennis balls containers are available, They possess certain inherent disadvantages which the present invention overcomes.

The present invention improves on the prior art by providing a multi-purpose tennis ball hopper, retriever and caddy contained within a convenient case which serves additional functions as a seat, a storage chamber, a secret container for valuables and is of molded construction. The present invention is cheaper and easier to manufacture and is more cosmetically appealing.

SUMMARY OF THE INVENTION

The present invention relates to an improved tennis ball retrieval and storage apparatus. In addition, the invention provides a multi-purpose tennis ball hopper, personal handy butler, (or caddy) that holds all of the tennis equipment used during play and practice. Some of the uses for the present invention include:

- a small storage unit (including a secret compartment for valuables) designed as a holder for new and practice tennis balls and other related tennis play equipment, e.g., towel, sweat bands, etc.;
- a convenient location for storage and attachment of soft bag containers suitable for personal items;
- a lightweight practice serving caddy;
- a tennis ball hopper that will pick up and hold up to 40 tennis balls;
- a place to keep all of the tennis equipment handy together and organized during game play;
- a space saver piece of sports equipment, that when the handle is retracted, will take up much less space than any other conventional tennis hoppers in use today;
- a unisex and juniors product, designed for ease of use by men and women and juniors.

It is therefore an object of the present invention to provide a tennis ball retriever that is light in weight and simple of construction, capable of being manufactured out of readily available materials and which is efficient in use.

These, together with the various ancillary objects and features of the invention which will become apparent as the following description proceeds, are attained by this tennis butler, a preferred embodiment of which has been shown in the accompanying drawings by way of example.

DETAILED DESCRIPTION OF A PREFERRED EMBODIMENT

Figure 1:
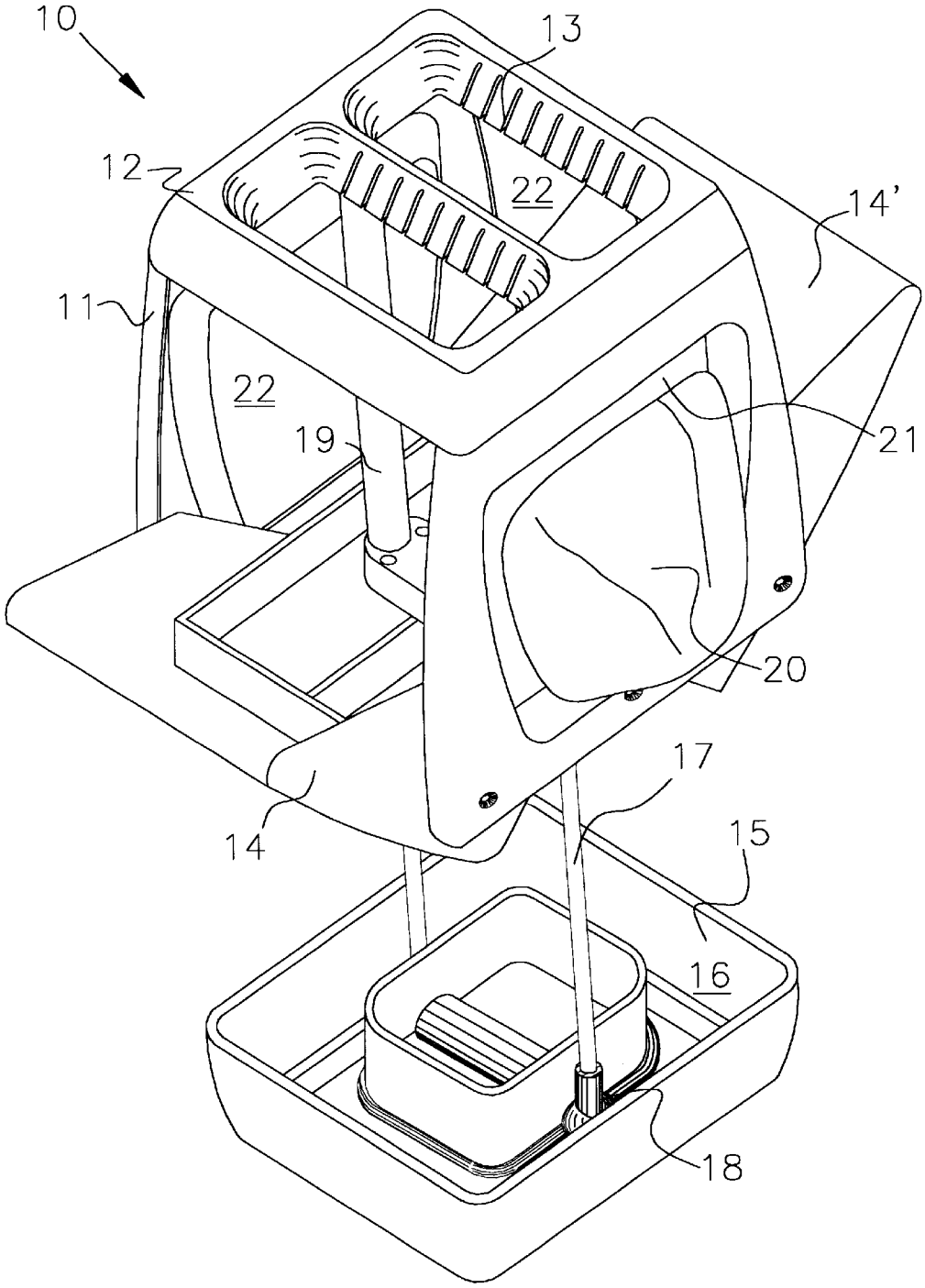
FIG. 1 is an isometric view of the tennis butler in its expanded position with the ball hopper open and storage bag attached.

With continuing reference to the accompanying drawings wherein like reference numerals designate similar parts throughout various views, reference numeral 10 generally designates the tennis butler constructed in accordance with the concept of the present invention.

The tennis butler 10 comprises several major parts including the outer case 11, side closures 14 and 14', base support 12, fingers 13, top 15 and sliding support tubes 17.

Referring now to FIG. 1, the tennis butler is inverted in its normal stand-by position for use during play. Pouch 20 attached to face 21 is accessible, and sides 14 and 14' are open giving access to storage space 22. Legs 17 are in their extended position from within tubes 19 and are attached to top cap 15 at joints 18.

Figure 2:
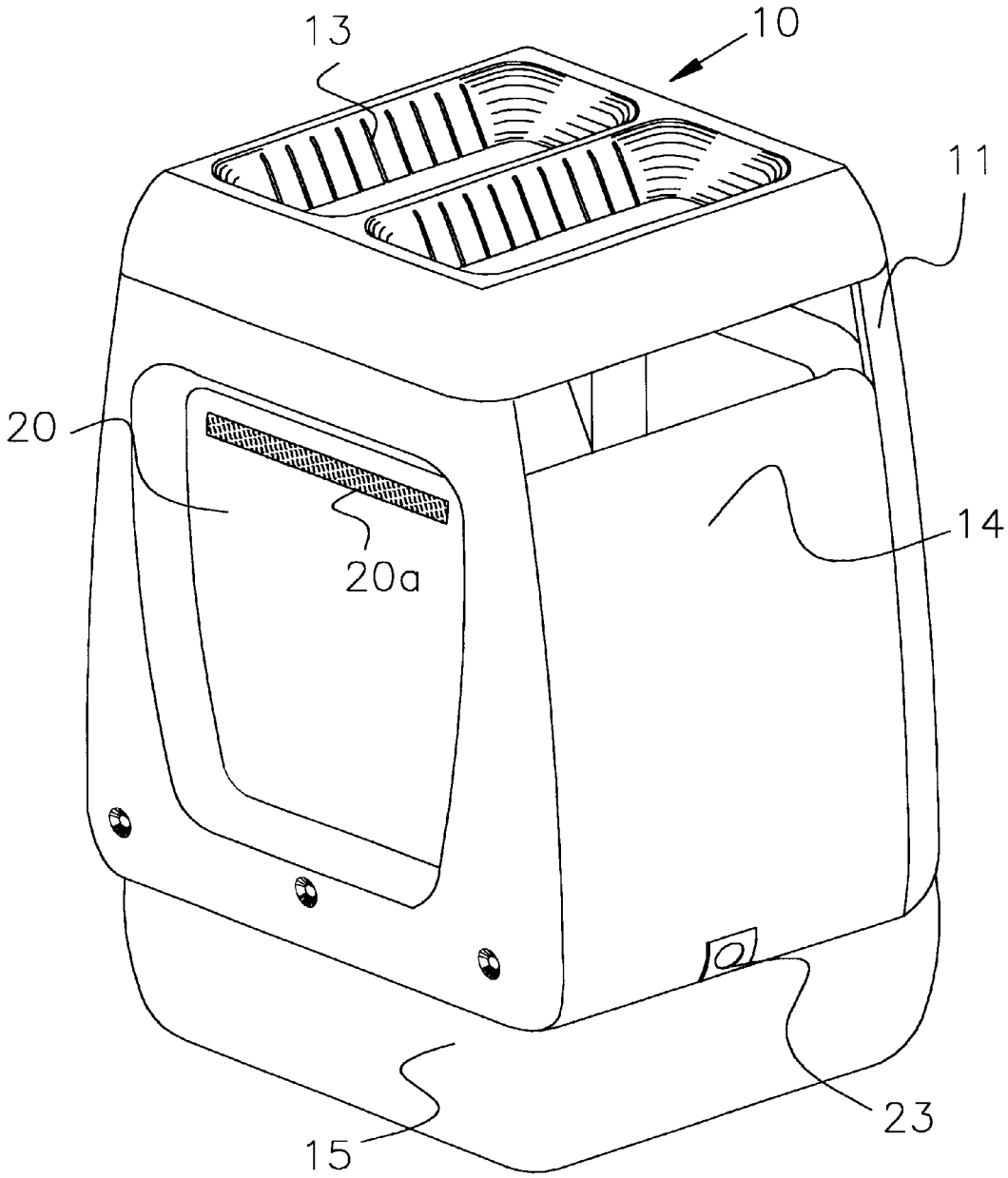
FIG. 2 is an isometric view of the tennis butler invention in its carrying mode.

Referring now to FIG. 2, the tennis butler is closed. Catch 23 is seen as side closure 14 is in its storage position. In this configuration, the tennis butler can be used as a seat and can be conveniently stored.

Figure 3:
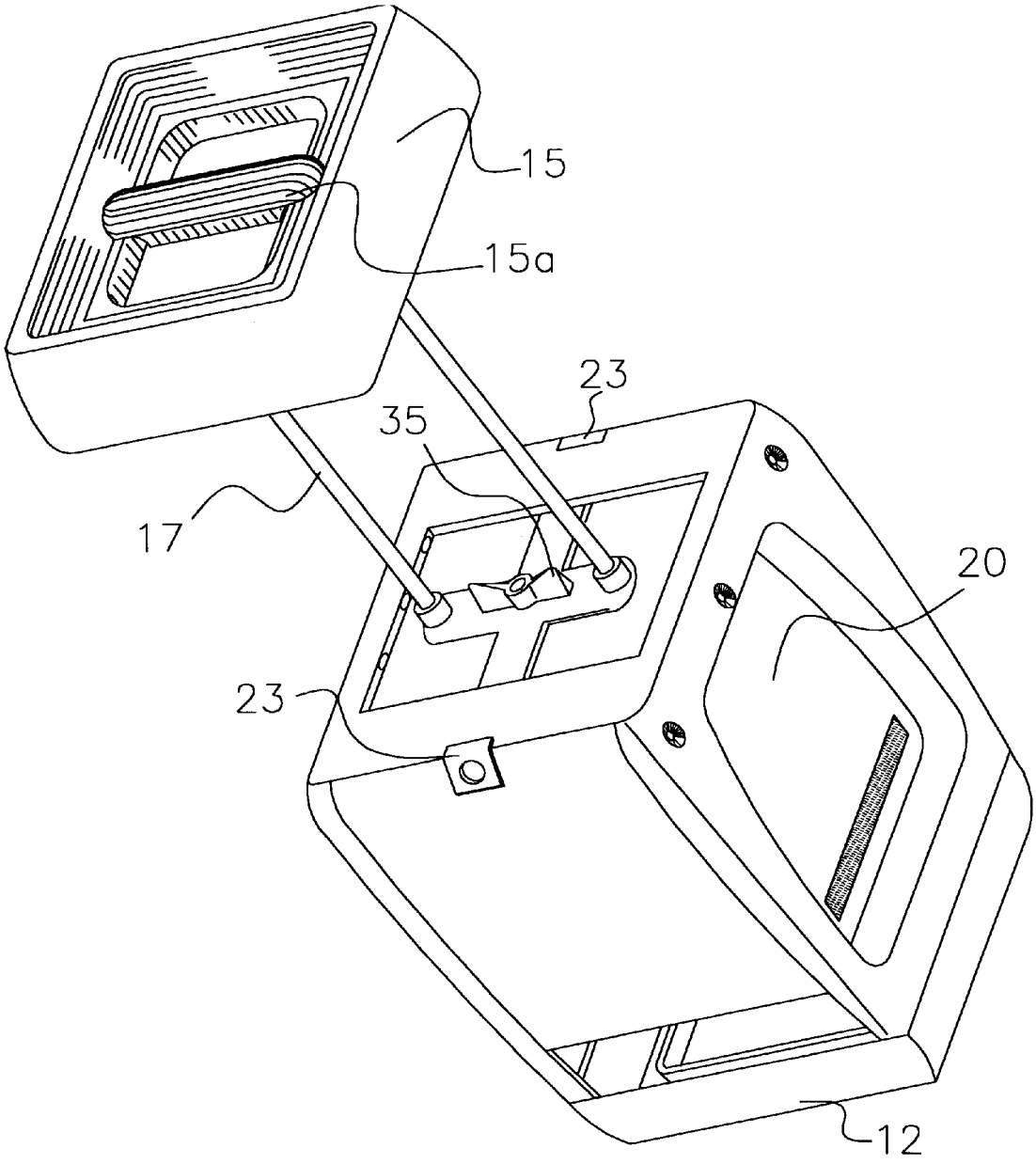
FIG. 3 is an isometric view of the invention in its inverted "ball retrieval" mode.

Referring now to FIG. 3, the tennis butler is in its ball retrieval mode. Handle 15*a* in top 15 is attached to the tennis butler by extended legs 17.

Figure 4:
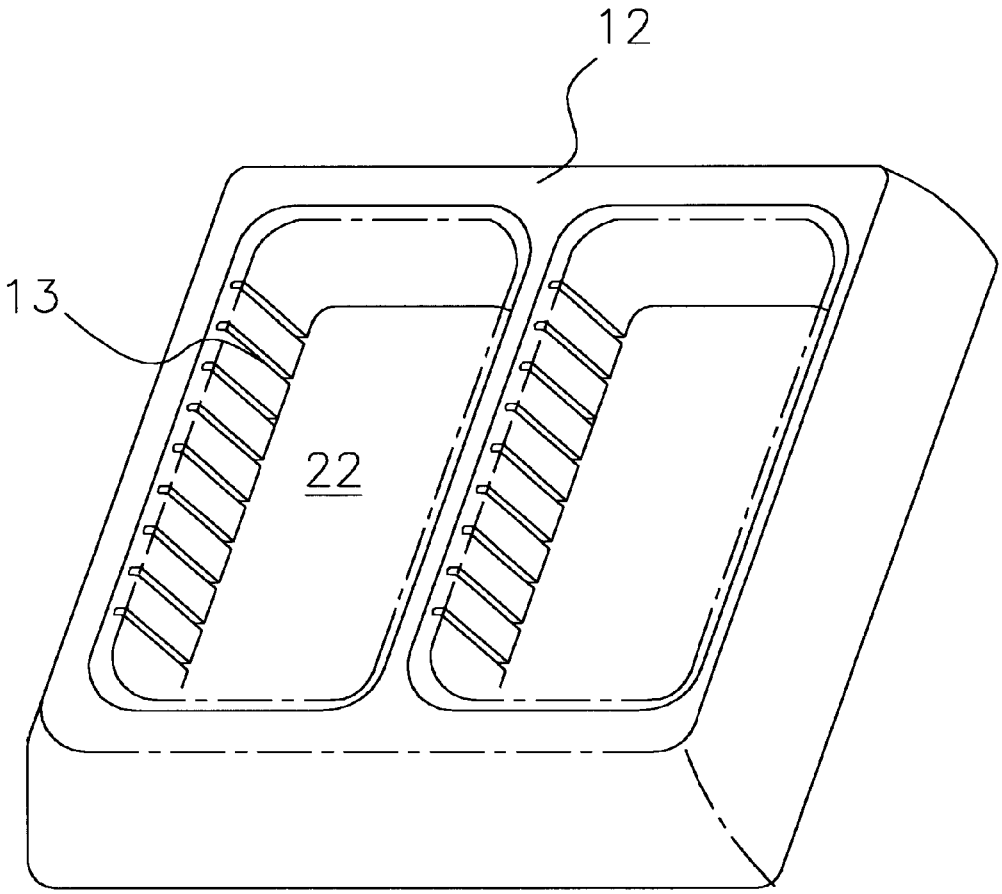
FIG. 4 is an isometric view of the ball retrieval "finger" device of the invention.

Referring now to FIG. 4, fingers 13 are arranged over space 22 to permit tennis balls to pass into space 22.

Figure 5:
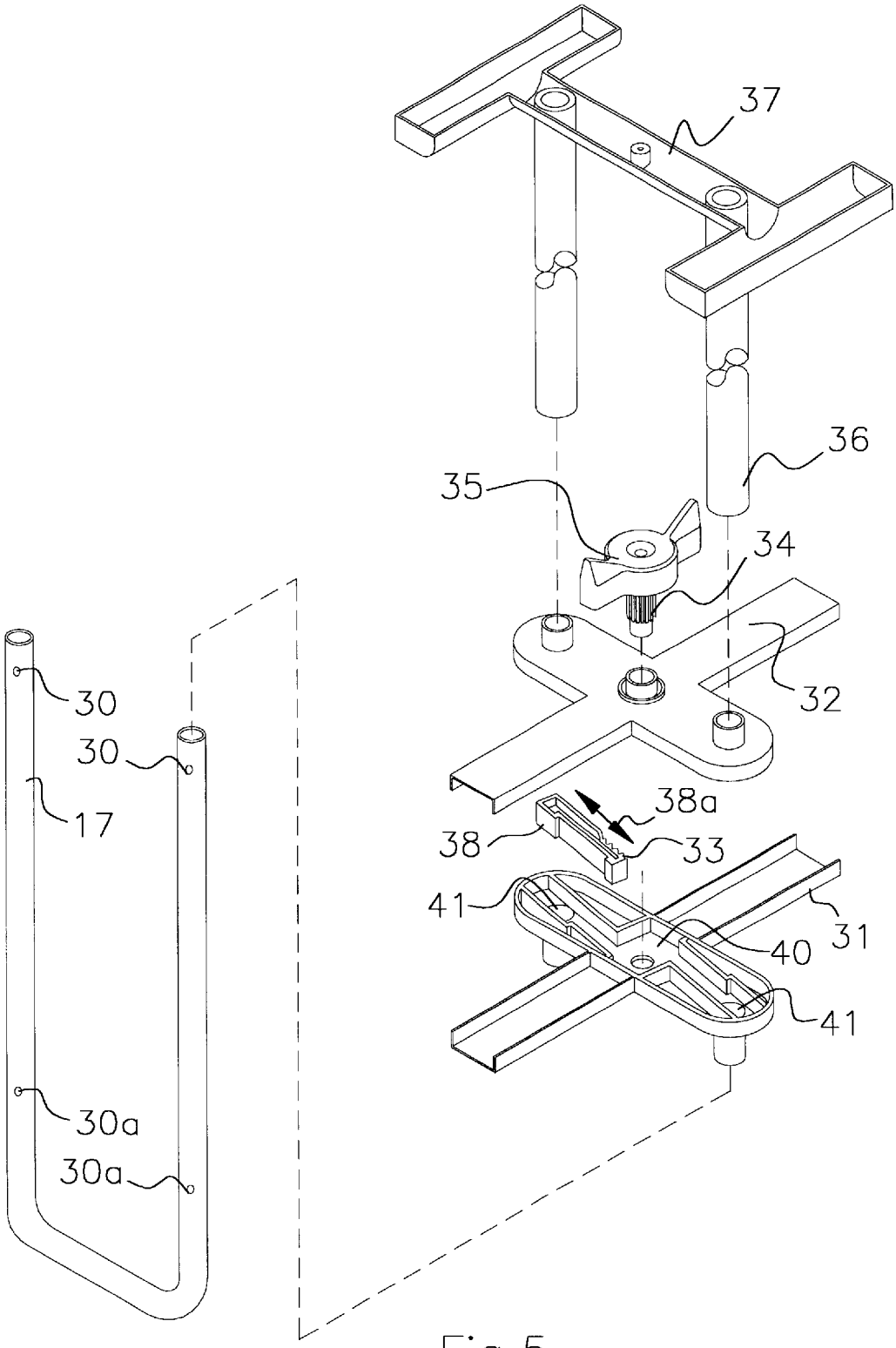
FIG. 5 is an exploded isometric view of the working components which comprise the handle locking and unlocking mechanism.
Figure 6:
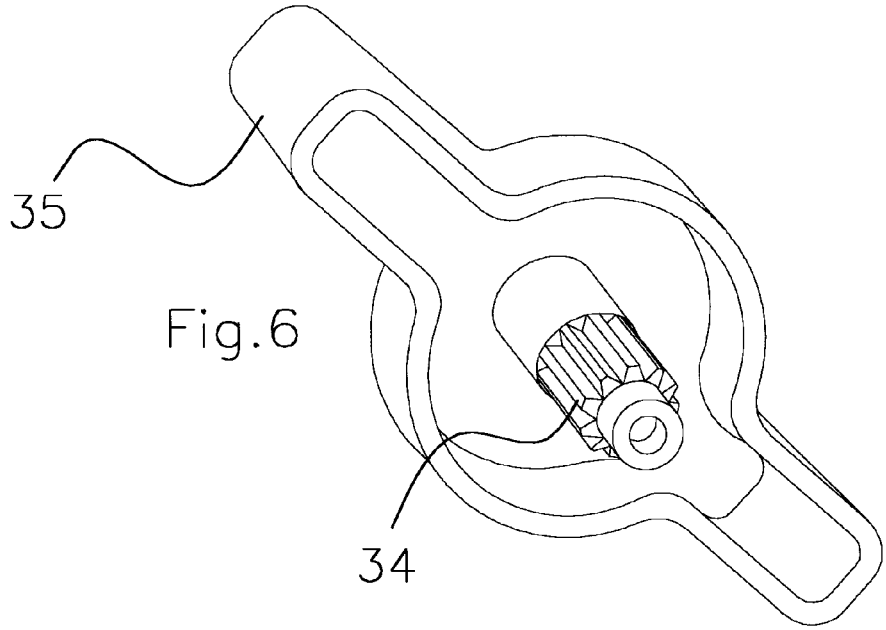
FIG. 6 is an isometric view of the underside of the leg pin locking gear.
Figure 7:
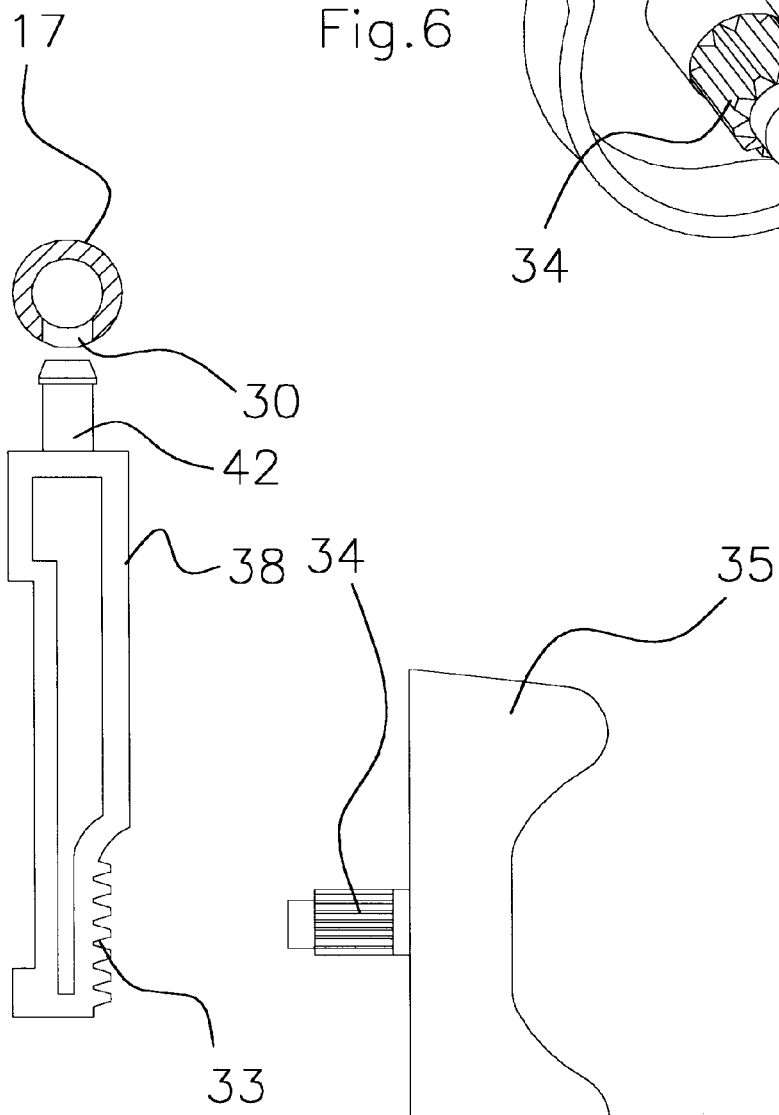
FIG. 7 is an elevational view of the gear rack and leg pin locking gear.

Referring now to FIG. 5, the component parts for extending and locking legs 17 in either their open or stored positions are shown. Storage tubes 36 attached to mount 37 attach to cover 32 and cover 32 in turn attaches to base 31 creating a housing with internal space 40. Gear rack 38 locates within space 40 and its rack 33 engages teeth 34 of gear 35. It will be evident to one skilled in the art that by rotating gear 35, gear rack 38 can be made to reciprocate within chamber 41 in the direction of arrows 38*a*. Holes 30 and 30*a* provide positive stops for pins 42 (FIG. 7) and as gear 35 is turned, pins 42 are pushed into or out of holes 30, 30*a*. This creates a locking mode for tubes 17 either in the stored position (holes 30*a*) or an extended position (holes 30). The mechanism described can be more clearly seen with reference to FIGS. 6 and 7 which show the dynamic relationship between gear rack 38, teeth 34 and gear 35.

While the present tennis butler is generally designed as a better, more compact hopper, it has achieved a multi-function product. Most tennis ball hoppers are constructed of a heavy steel substance using a rubberized coating. The present invention has reduced the weight, which is approximately one half that of a normal hopper in weight and it has the added advantage of being constructed of molded plastic or other suitable material. The present invention is less cumbersome when stored or used than any other prior art hoppers. The present invention was designed with the idea that men, women or juniors may have ease of use. The preferred embodiment is constructed from lightweight molded plastic components which are designed for added strength by adding compound curves and radii to form a uni-body shell upon which adjustable features can be attached and stored. The use of a gear/rack and pin arrangement to lock and unlock the telescoping legs makes one hand activation and deployment possible. This feature is especially useful at the end of a practice session when the user can simply close up the body, invert the unit and, carrying it by the handle, pick up balls without bending. The product was designed for multi-purpose use, i.e. for practice and for playing tennis. The major difference is in the appearance, construction, function, weight, size, portability and completeness with multi-purpose use in mind.

What is claimed is:

1. A tennis ball retrieving, storing, and serving apparatus for collecting tennis balls from a playing surface, storing the balls for subsequent use, and conveniently providing the tennis balls for use, said apparatus comprising:

a tennis ball hopper body having a first end wall and a second end wall, side walls, a top portion of said first end wall and a top portion of said second end wall, a first opening and a second opening in each of said side walls, said openings having a spaced apart relationship on opposite sides of said hopper body, said openings having pivotally attached movable sides, said sides having locking means, said locking means having spring loaded releasable catching means, a base support affixed to said hopper body, said base support having a pair of opening spaces, said base support having a plurality of fingers formed therein for permitting tennis balls to pass into said opening spaces, a first and second vertical tubular storage means affixed within said hopper body, said tubular storage means having slideably adjustable tubular support means, said support means being formed generally in a "U" shape having a top end and a first leg and a second leg, said first and second legs being pierced by a plurality of holes, said support means being affixed by said top end to said top portion of said end walls, said support means having locking means, said support means being releasably locked within said tubular storage means, said locking means having a toothed rack and a toothed pinion, said rack having a protruding pin, said pin being axially aligned to said holes in said first and said second legs, said pin being reversibly pushed into said holes, and a base handle and "U" shaped support means, said handle being attached to said "U" shaped support means, said support means being selectively lengthened or shortened fore access to said tennis balls, and for supporting said hopper body for tennis ball retrieval, and shortened for use as a carrying handle, attachment means affixed to said end walls, and a first and second removably attached soft sided storage pouch attachable to said side walls.

* * * * *